US010261451B2

(12) United States Patent
Minobe

(10) Patent No.: US 10,261,451 B2
(45) Date of Patent: Apr. 16, 2019

(54) IMAGE FORMING APPARATUS

(71) Applicant: CANON KABUSHIKI KAISHA, Tokyo (JP)

(72) Inventor: Taro Minobe, Ichikawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/838,846

(22) Filed: Dec. 12, 2017

(65) Prior Publication Data

US 2018/0181033 A1 Jun. 28, 2018

(30) Foreign Application Priority Data

Dec. 22, 2016 (JP) ..... 2016-249533

(51) Int. Cl.
*G03G 15/16* (2006.01)

(52) U.S. Cl.
CPC ..... *G03G 15/1675* (2013.01); *G03G 15/161* (2013.01); *G03G 15/1615* (2013.01)

(58) Field of Classification Search
CPC ..... G03G 15/1675; G03G 15/161; G03G 15/1615
See application file for complete search history.

(56) References Cited

U.S. PATENT DOCUMENTS 9,046,861 B2 6/2015 Ohno et al.
9,158,238 B2 10/2015 Katagiri et al.
9,229,376 B2 1/2016 Yasukawa
9,417,568 B2 8/2016 Katagiri et al.
9,817,342 B2 11/2017 Katagiri et al.
2013/0259543 A1* 10/2013 Katagiri ..... G03G 15/5004 399/302
2015/0168877 A1* 6/2015 Tetsuno ..... G03G 15/1605 399/313
2018/0032023 A1* 2/2018 Shimizu ..... G03G 15/80
2018/0039198 A1* 2/2018 Saito ..... G03G 15/0121

FOREIGN PATENT DOCUMENTS

JP 2013-078252 A 4/2013
JP 2013-231942 A 11/2013
JP 2015-011063 A 1/2015
JP 2016-057639 A 4/2016

* cited by examiner

*Primary Examiner* — Carla J Therrien
(74) *Attorney, Agent, or Firm* — Venable LLP

(57) ABSTRACT

The image forming apparatus includes a photosensitive drum, an intermediate transfer belt, a secondary transfer roller, a secondary transfer power supply, an opposing roller through which a current flows through the intermediate transfer belt when the voltage is applied to the secondary transfer roller by the secondary transfer power supply, metal rollers electrically connected to the opposing roller and contacting an inner peripheral surface of the intermediate transfer belt in vicinities of the photosensitive drums, a current restriction circuit connected to a path of a current flowing from the opposing roller to the metal rollers when the voltage is applied to the secondary transfer roller by the secondary transfer power supply, the current restriction circuit configured to restrict the current from the opposing roller to the metal rollers to a predetermined current.

20 Claims, 8 Drawing Sheets

IMAGE FORMING APPARATUS

BACKGROUND OF THE INVENTION

Field of the Invention

The present invention relates to an electrophotographic image forming apparatus such as a copying machine and printer.

Description of the Related Art

As an electrophotographic image forming apparatus, an image forming apparatus including an intermediate transfer member has been known. In a conventional image forming apparatus, a primary transfer member is disposed in such a manner as to face a photosensitive drum with an intermediate transfer member interposed therebetween, and the photosensitive drum contacting the intermediate transfer member to form a primary transfer nipping unit. To the primary transfer member, voltage is applied by a first high-voltage power supply. This application of voltage generates a primary transfer potential in the primary transfer unit. A potential difference is generated between the photosensitive drum and the intermediate transfer member, causing a toner image formed on a surface of the photosensitive drum serving as an image bearing member to be transferred to the intermediate transfer member (hereafter, referred to as a primary transfer step). The primary transfer step is iteratively executed on a toner image of each of multiple colors, whereby toner images of the respective colors are formed on a surface of the intermediate transfer member. Next, voltage is applied from a second high-voltage power supply to a secondary transfer member, whereby the toner images of the multiple colors formed on the surface of the intermediate transfer member are collectively transferred to a surface of a recording material such as paper (hereafter, referred to as a secondary transfer step). The toner images collectively transferred to the surface of the recording material in the secondary transfer step are fused on the recording material by a fixing device (hereafter, referred to as a fusing step).

There is a configuration in which, for example, use is made of an endless belt (hereafter, referred to as an intermediate transfer belt) as the intermediate transfer member, and the intermediate transfer belt is tensioned by a plurality of tensioning members on an inner peripheral surface of the intermediate transfer belt. Japanese Patent Application Laid-Open No. 2013-231942 discloses a configuration in which a contact member contacting the intermediate transfer belt is connected to a voltage maintaining element in a region on the intermediate transfer belt between a tensioning member and a tensioning member where the toner images are transferred from the plurality of image bearing members. According to Japanese Patent Application Laid-Open No. 2013-231942, primary transfer is performed not by using a high-voltage power supply for the primary transfer but by causing current to flow from a high-voltage power supply for secondary transfer via a secondary transfer member and a tensioning member facing the secondary transfer member into the voltage maintaining element connected to the contact member contacting the intermediate transfer belt. In such a configuration, a primary transfer potential in a primary transfer unit is generated by a constant voltage that occurs when the current is caused to flow into the voltage maintaining element.

However, in the configuration in the conventional example where the primary transfer is performed by causing current to flow from a current supply member into the voltage maintaining element connected to the contact member contacting the intermediate transfer belt, the primary transfer potential in the primary transfer unit maintains a constant potential by the voltage maintaining element. For that reason, when an impedance of the primary transfer unit fluctuates greatly, an image fused on a recording material may incur poor transfer such as poor density.

SUMMARY OF THE INVENTION

An aspect the present invention is an image forming apparatus including an image bearing member configured to bear a toner image, an intermediate transfer belt onto which a toner image is primarily transferred from the image bearing member, the intermediate transfer belt having a conductivity and being endless, a secondary transfer member configured to secondarily transfer the toner image from the intermediate transfer belt to the transfer member, the secondary transfer member contacting an outer peripheral surface of the intermediate transfer belt, a transfer power supply configured to apply a voltage to the secondary transfer member, an opposing member supporting an inner peripheral surface of the intermediate transfer belt, the opposing member provided to oppose the secondary transfer member through the intermediate transfer belt, a contact member provided to correspond to oppose the image bearing member through the intermediate transfer belt, the contact member contacting the inner peripheral surface of the intermediate transfer belt, and a current restriction circuit electrically connected to the contact member and the opposing member, to restrict an amount of current flowing from the opposing member to the contact member in a case where a voltage is applied from the transfer power supply to the secondary transfer member, to a predetermined amount of current, independently of variation of resistance value of the intermediate transfer belt.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiment 1

[Overview of Color Image Forming Apparatus]

Figure 1:
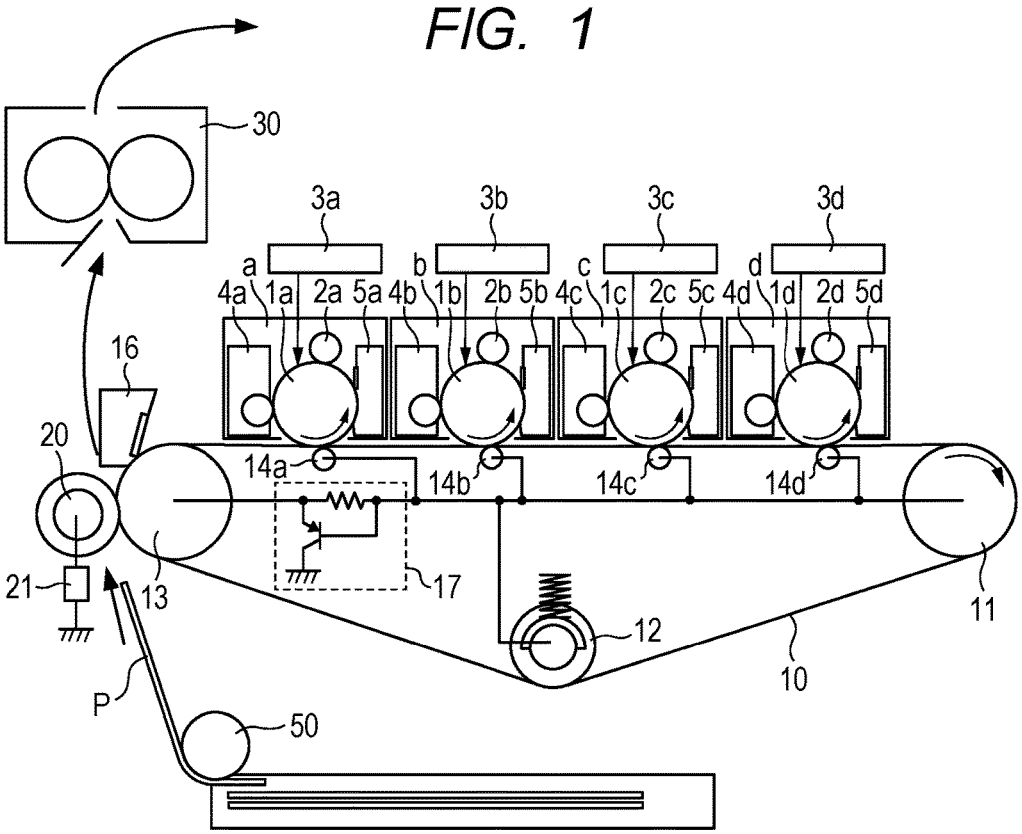
FIG. 1 is a schematic diagram used for describing an image formation apparatus of Embodiment 1.

FIG. 1 is a schematic diagram illustrating an example of a color image forming apparatus. With reference to FIG. 1, a configuration and an operation of an image forming apparatus in Embodiment 1 will be described. The image forming apparatus in Embodiment 1 is a tandem printer provided with four image formation stations a to d. A first image formation station a is configured to form a yellow (Y) image, a second image formation station b is configured to form a magenta (M) image, a third image formation station c is configured to form a cyan (C) image, and a fourth image formation station d is configured to form a black (Bk) image. The image formation stations a to d have the same configuration except for colors of toners stored in the respective image formation stations. Hereafter, description will be made about the first image formation station a.

The first image formation station a includes a drum-shaped electrophotographic photosensitive member (hereafter, referred to as a photosensitive drum) 1*a* as an image bearing member, a charge roller 2*a*, a developing device 4*a*, and a cleaning device 5*a*. The photosensitive drum 1*a* is an image bearing member configured to be rotary driven in a direction illustrated by an arrow, at a predetermined circumferential speed (hereafter, referred to as a process speed) and configured to bear a toner image. The developing device 4*a* is a device for storing a yellow toner and developing the yellow toner on the photosensitive drum 1*a*. The cleaning device 5*a* is a member for collecting the toner adhered to the photosensitive drum 1*a*. In Embodiment 1, the cleaning device 5*a* includes a cleaning blade being a cleaning member adapted to contact with the photosensitive drum 1*a* and a waste toner box adapted to store the toner collected by the cleaning blade.

Upon receiving an image signal, a controller (see FIG. 2) configured to control the entire image forming apparatus starts an image forming operation, at which the photosensitive drum 1*a* is rotary driven. The photosensitive drum 1*a* undergoes a rotation process and is subjected to a charging process, so as to uniformly have a predetermined polarity (a negative polarity in Embodiment 1) and a predetermined potential, by the charge roller 2*a*. The photosensitive drum 1*a* subjected to the charging process is exposed to light according to the image signal, by an exposure device 3*a*. This exposure forms an electrostatic latent image corresponding to a yellow color component image on the photosensitive drum 1*a*, out of intended color images. The electrostatic latent image formed on the photosensitive drum 1*a* is developed by the developing device 4*a* at a development position, so as to be visualized as a yellow toner image. Here, a regular polarity of the toner stored in the developing device 4 is a negative polarity. In Embodiment 1, the electrostatic latent image is subjected to reversal development by the toner charged to have a polarity the same as the charged polarity of the photosensitive drum 1 given by the charge roller 2. However, the present invention is applicable to an electrophotographic apparatus configured to subject an electrostatic latent image to normal development by a toner charge to have a polarity reverse to a charged polarity of a photosensitive drum 1.

The intermediate transfer belt 10 is tensioned by a plurality of tensioning members 11, 12 and 13, includes an opposing portion adapted to contact with the photosensitive drum 1*a*, and is movable in a moving direction of the photosensitive drum 1*a* at substantially the same circumferential speed as the photosensitive drum 1*a*. The yellow toner image formed on the photosensitive drum 1*a* is transferred to the intermediate transfer belt 10 (hereafter, referred to as primary transfer) in a course of passing through a contact portion between the photosensitive drum 1*a* and the intermediate transfer belt 10 (hereafter, referred to as a primary transfer unit).

In Embodiment 1, the primary transfer involves causing current to flow into the intermediate transfer belt 10 from a current supply member contacting the intermediate transfer belt 10, and the current generates a primary transfer potential in a primary transfer unit of the intermediate transfer belt 10 in each of the image formation stations. A method for generating the primary transfer potential in Embodiment 1 will be described later. Residual toner on a surface of the photosensitive drum 1*a* is removed by the cleaning device 5*a*, so that the photosensitive drum 1*a* is cleaned. The cleaned photosensitive drum 1*a* is to be subjected to an image formation process that includes charging and subsequent steps. Subsequently, in the second, third, and fourth image formation stations b, c, d, a magenta toner image of a second color, a cyan toner image of a third color, and a black toner image of a fourth color are formed similarly, and transferred to the intermediate transfer belt 10 one by one in the respective primary transfer units. The indexes a to d following reference numerals, which are used corresponding to YMCBk, may be omitted unless the indexes are necessary.

Through the above steps, on the intermediate transfer belt 10, a full-color image equivalent to the intended color images is formed. The toner images of the four colors on the intermediate transfer belt 10 are collectively transferred to a surface of a recording material P fed by a sheet feeder 50 in a course of passing through a secondary transfer unit formed by the intermediate transfer belt 10 and a secondary transfer roller 20 (hereafter, referred to as secondary transfer). The secondary transfer roller 20 as a secondary transfer member contacts an outer peripheral surface of the intermediate transfer belt 10 with a pressing force, forming the secondary transfer unit. The secondary transfer roller 20 is rotated in such a manner as to follow the intermediate transfer belt 10. The secondary transfer roller 20 is a member for transferring a toner image on the intermediate transfer belt 10 onto a recording material P.

A secondary transfer power supply 21 (transfer power supply) being first application unit includes a transformer configured to generate a high voltage, and is configured to supply a secondary transfer voltage to the secondary transfer roller 20. Voltage output from the transformer is controlled to be substantially constant by the controller, whereby the secondary transfer voltage supplied to the secondary transfer roller 20 by the secondary transfer power supply 21 is controlled to be constant. The secondary transfer power supply 21 is capable of outputting a voltage ranging from 100 to 4000 [V].

The recording material P to which the toner images of the four colors are transferred in the secondary transfer unit is heated and pressurized by a fuser 30. This heating and pressurization cause the toners of the four colors to be fused and mixed together, fixed to the recording material P. Toner residing on the intermediate transfer belt 10 after the secondary transfer is removed by a cleaning device 16 including a cleaning blade, so that the intermediate transfer belt 10 is cleaned. Through the above operation, a full-color printed image is formed. A current restriction circuit 17 will be described later.

[Overview of Controller]

Figure 2:
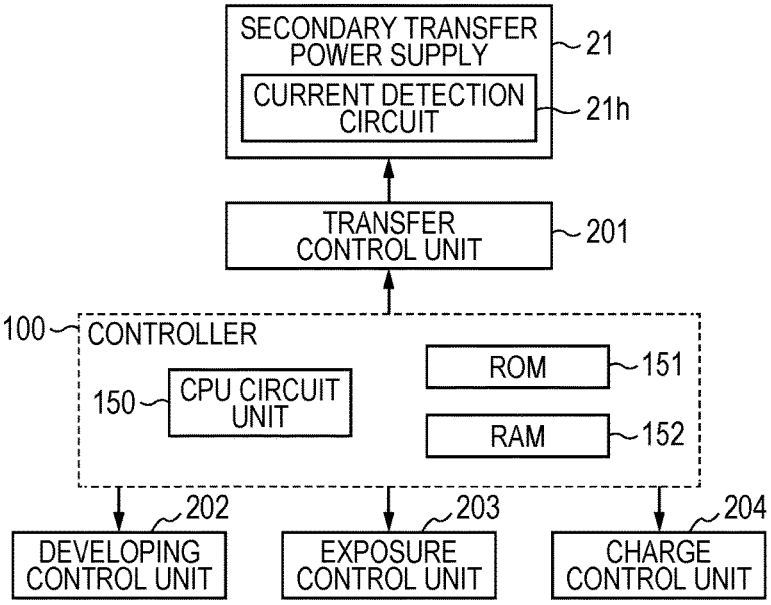
FIG. 2 is a block diagram used for describing control units of image forming apparatuses of Embodiments 1 to 5.

Description will be made about a configuration of a controller 100 configured to control the entire image forming apparatus, with reference to FIG. 2. As illustrated in FIG. 2, the controller 100 includes a CPU circuit unit 150. The CPU circuit unit 150 is capable of writing data into a RAM 152 and reading data from a ROM 151 and the RAM 152. The CPU circuit unit 150 is configured to comprehensively control a transfer control unit 201, a developing control unit 202, an exposure control unit 203, and a charge control unit 204, according to a control program stored in the ROM 151. The ROM 151 is configured to store an environment table and a paper thickness correspondence table, which are reflected in the control program as necessary. The RAM 152 is used for temporarily saving control data acquired from the image forming apparatus and is used as a working area for calculation processing associated with execution of the control program. The transfer control unit 201 being a control unit is configured to control the secondary transfer power supply 21, according to instructions from controller 100.

The secondary transfer power supply 21 includes a current detection circuit 21*h*. The current detection circuit 21*h* being a detection unit is configured to detect current that flows through the secondary transfer roller 20 as voltage is applied to the secondary transfer roller 20 by the secondary transfer power supply 21. The transfer control unit 201 is configured to control a value of voltage output from the secondary transfer power supply 21, based on a load current flowing through the secondary transfer roller 20 and detected by the current detection circuit 21*h*. Hereafter, the load current flowing through the secondary transfer roller 20 will be referred to as a secondary transfer current i2 (see FIG. 4). When the controller 100 receives image information and a print command from a host computer (not illustrated), the CPU circuit unit 150 controls control units (the transfer control unit 201, the developing control unit 202, the exposure control unit 203, and the charge control unit 204) to execute the image forming operation.

[Overview of Intermediate Transfer Belt]

Next, description will be made in detail about the intermediate transfer belt 10, the tensioning members 11, 12 and 13, and the contact member 14. The intermediate transfer belt 10 is tensioned by three shafts: the tensioning members 11, 12 and 13. Hereafter, the tensioning member 11 will be referred to as a drive roller 11, the tensioning member 12 will be referred to as a tension roller 12, and the tensioning member 13 will be referred to as a secondary transfer opposing roller 13 being a secondary transfer opposing member (hereafter, referred to as an opposing roller 13). Contact members 14*a* to 14*d* are members electrically connected to the opposing roller 13, which is one of the tensioning members, and being contact the inner peripheral surface of the intermediate transfer belt 10 in vicinities of the photosensitive drums 1*a* to 1*d*, respectively. At positions where the contact members 14*a* to 14*d* face the photosensitive drums 1*a* to 1*d*, respectively, the intermediate transfer belt 10 is disposed as an intermediate transfer member. The intermediate transfer belt 10 is an endless belt having a conductivity given by adding a conductive agent to a resin material.

The opposing roller 13 is one of the multiple tensioning members and a member through which current flows via the intermediate transfer belt 10 when voltage is applied to the secondary transfer roller 20 by the secondary transfer power supply 21. The opposing roller 13 is a roller forming a nipping unit with the secondary transfer roller 20. The intermediate transfer belt 10 is movable in the same direction as a rotation direction of the photosensitive drums 1*a* to 1*d* in opposing portions contacting with the photosensitive drums 1*a*, 1*b*, 1*c* and 1*d*, at substantially the same circumferential speed as the circumferential speed of the photosensitive drums 1*a*, 1*b*, 1*c* and 1*d*. The intermediate transfer belt 10 is adapted to move at the substantially same circumferential speed as the circumferential speed of the photosensitive drums 1*a* to 1*d*, by the drive roller 11 adapted to rotate by a driving source (not illustrated).

As illustrated in FIG. 1, in the moving direction of the intermediate transfer belt 10, the contact member 14*a* is disposed in the vicinity of the photosensitive drum 1*a*, and the contact member 14*a* contacts the intermediate transfer belt 10. The contact member 14*a* is, for example, a metal roller and will hereafter be referred to as a metal roller 14*a*. The contact members 14*b* to 14*d* will hereafter also be referred to as metal rollers 14*b* to 14*d*. The metal roller 14*a* is made up of a SUS round bar disposed to contact an inner peripheral surface side of the intermediate transfer belt 10. The metal roller 14*a* is adapted to press against the intermediate transfer belt 10 from below in FIG. 1 so that the intermediate transfer belt 10 reliably comes into contact with the photosensitive drum 1*a*. The metal roller 14*a* is rotated in such a manner as to follow the movement of the intermediate transfer belt 10. The same holds true for the contact members 14*b* to 14*d*.

The secondary transfer power supply 21 is configured to apply voltage to the secondary transfer roller 20, so as to cause current to flow into opposing roller 13 from the secondary transfer roller 20 via the intermediate transfer belt 10. As viewed from the opposing roller 13, the secondary transfer roller 20 functions as the current supply member. The opposing roller 13 is electrically connected to the metal rollers 14*a* to 14*d*. The current flowing into the opposing roller 13 therefore flows into the metal rollers 14*a*, 14*b*, 14*c* and 14*d* and via the metal rollers 14*a*, 14*b*, 14*c* and 14*d*, flows into the intermediate transfer belt 10 forming the respective primary transfer units. This current generates primary transfer potentials in the primary transfer units. Potential differences between the primary transfer potentials and photosensitive drum potentials in the primary transfer units cause toners on the photosensitive drums 1*a*, 1*b*, 1*c* and 1*d* (image bearing members) to move from the photosensitive drums 1*a*, 1*b*, 1*c* and 1*d* onto the intermediate transfer belt 10. The primary transfer is thus performed in the primary transfer units. The secondary transfer power supply 21 functions as a power supply for applying the secondary transfer voltage to the secondary transfer roller 20 and also functions as a current supply source for supplying current to the intermediate transfer belt 10 so as to generate the primary transfer potentials in the primary transfer units.

[Method for Generating Primary Transfer Potential]

Figure 3:
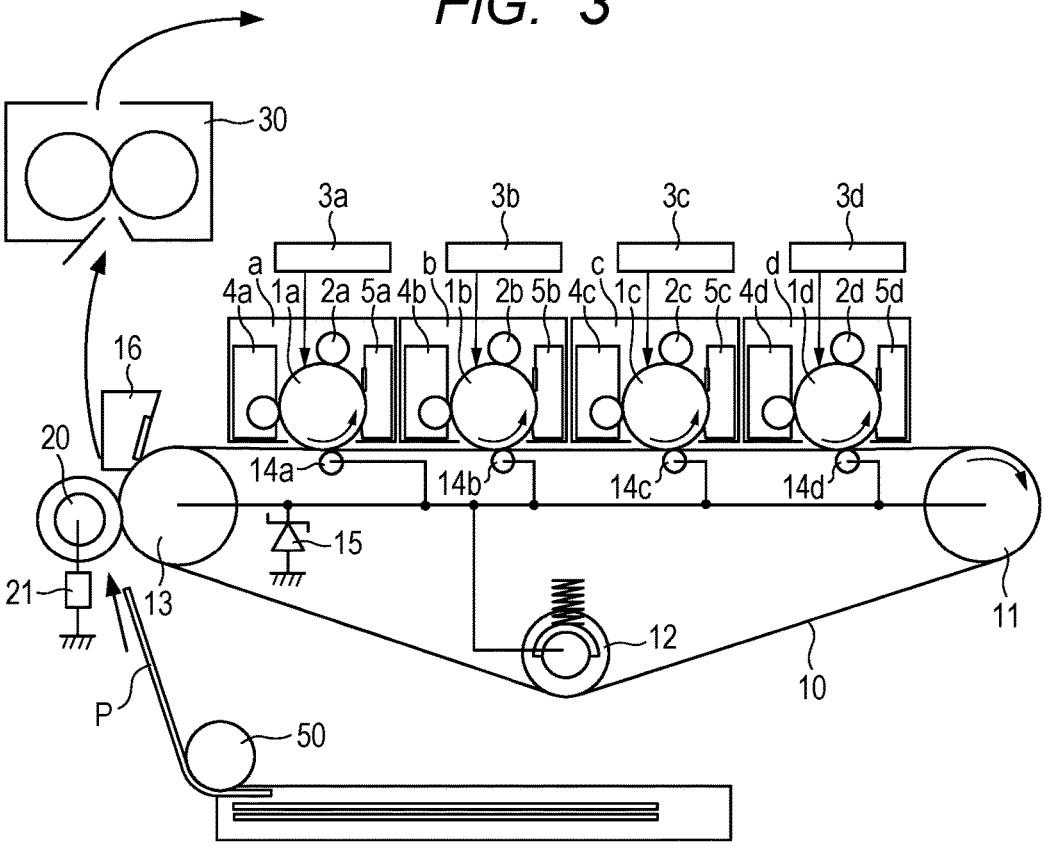
FIG. 3 is a schematic diagram used for describing an image formation apparatus in a comparative example of Embodiment 1.

Description will be made in detail about a method for generating a primary transfer potential used for execution of the primary transfer, which is a feature of the present invention, in comparison with a conventional example. FIG. 3 is a schematic diagram illustrating an example of a conventional color image forming apparatus as the comparative example. It should be noted that components identical to those in FIG. 1 have the same reference numerals. In the comparative example, the opposing roller 13 and the drive roller 11 are electrically connected to the voltage maintaining element 15 and grounded via the voltage maintaining element 15. When voltage is applied from the secondary transfer power supply 21 to the secondary transfer roller 20 being the current supply member, current flows from the secondary transfer roller 20 to the voltage maintaining element 15 via the intermediate transfer belt 10 and the opposing roller 13. This current keeps the opposing roller 13 and the drive roller 11 connected to the voltage maintaining element 15 at a predetermined potential. The predetermined potential is a potential set so that the primary transfer potentials can be kept in the respective primary transfer units, the primary transfer potentials each allowing a predetermined transfer efficiency to be provided. The metal rollers 14*a*, 14*b*, 14*c* and 14*d* are disposed as contact members contacting the intermediate transfer belt 10 in the vicinities of the photosensitive drums 1*a*, 1*b*, 1*c* and 1*d*, and the metal rollers 14*a*, 14*b*, 14*c* and 14*d* are also electrically grounded via the voltage maintaining element 15. However, for example, the intermediate transfer belt may be made of a material to which a conductive agent having an ion conductivity is added. Such an intermediate transfer belt greatly fluctuates in resistance value with environmental variations, and a fluctuation width of an impedance of the primary transfer units is thereby made large. For that reason, when potentials of the primary transfer units are kept constant, a fluctuation width of current flowing into the primary transfer units is made large. Ensuring a primary transfer property is thus difficult regardless of environment.

Hence, Embodiment 1 is intended for a stable supply of a proper primary transfer current to the primary transfer units regardless of environment. To this end, the current restriction circuit 17 is connected to a current path between the opposing roller 13 and the metal rollers 14*a*, 14*b*, 14*c* and 14*d*, as illustrated in FIG. 1. The current restriction circuit 17 is configured to restrict an amount of the current flowing from the secondary transfer roller 20 being the current supply member via the intermediate transfer belt 10 and the opposing roller 13, to a given amount. That is, the current restriction circuit 17 is a circuit electrically connected to the metal rollers 14*a*, 14*b*, 14*c* and 14*d* and the opposing roller 13, and configured to restrict the amount of the current that flows from the opposing roller 13 to the metal rollers 14*a*, 14*b*, 14*c* and 14*d* when voltage is applied to the secondary transfer roller 20 by the secondary transfer power supply 21, to a predetermined amount, irrespective of fluctuations in the resistance value of the intermediate transfer belt 10.

This restriction enables the proper primary transfer current to flow to the primary transfer units regardless of fluctuations in impedance occurring in the primary transfer units due to various factors. The current restriction circuit 17 is a circuit connected in the path of current that flows from the opposing roller 13 to the metal rollers 14 when voltage is applied to the secondary transfer roller 20 by the secondary transfer power supply 21 and is a circuit restriction current flowing from the opposing roller 13 to the metal rollers 14, to a predetermined current. A configuration of the current restriction circuit 17 will be described below.

[Current Restriction Circuit]

Figure 4:
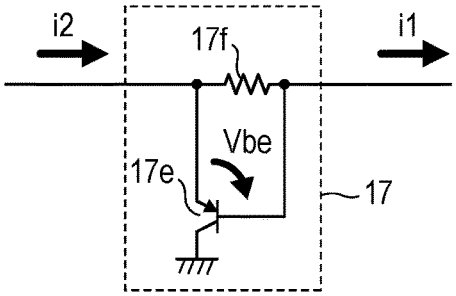
FIG. 4 is a schematic circuit diagram used for describing a configuration of a current restriction circuit of Embodiment 1.

Next, the current restriction circuit 17 will be described with reference to FIG. 4. The current restriction circuit 17 in Embodiment 1 includes a PNP transistor 17*e* (hereafter, referred to as a transistor 17*e*) and a resistor 17*f*. The resistor 17*f* includes one end connected to the opposing roller 13 and another end connected to the metal rollers 14. The transistor 17*e* includes an emitter terminal connected to the opposing roller 13 and a base terminal connected to the emitter terminal via the resistor 17*f*. The transistor 17*e* includes a collector terminal grounded. More in detail, in the transistor 17*e*, the emitter terminal is connected to the opposing roller 13 and the one end of the resistor 17*f*, the base terminal is connected to the metal rollers 14 and the other end of the resistor 17*f*, and the collector terminal is grounded.

In the current restriction circuit 17, when a secondary transfer current i2 flows from the secondary transfer roller 20 being the current supply member, voltage is applied between the base terminal and the emitter terminal of the transistor 17*e*, and current flows into the base terminal of the transistor 17*e*. At this point, a current i1 flowing through the resistor 17*f* is expressed by Formula (1) below using a base-emitter voltage Vbe of the transistor 17 and a resistance value R1 of the resistor 17*f*.

$$i1=Vbe/R1 \quad (1)$$

Here, a base current in the transistor 17*e* has a current value sufficiently small as compared with the secondary transfer current i2, and the current i1 calculated by Formula (1) can be regarded as a total of values of currents flowing into the metal rollers 14*a*, 14*b*, 14*c* and 14*d*. The current i1 will hereafter be referred to as a primary transfer current i1. For example, assuming that a predetermined value of the primary transfer current i1 is 20 [μA], the primary transfer current flowing into the metal rollers 14*a*, 14*b*, 14*c* and 14*d* and necessary in the primary transfer, the resistance value R1 of the resistor 17*f* is set as follows. Typically, the base-emitter voltage Vbe of the transistor 17 substantially satisfies Vbe=0.7 [V], and thus, from Formula (1), the resistance value R1 of the resistor 17*f* is about 35 [kΩ].

[Current Path of Secondary Transfer Power Supply]

Figure 5A:
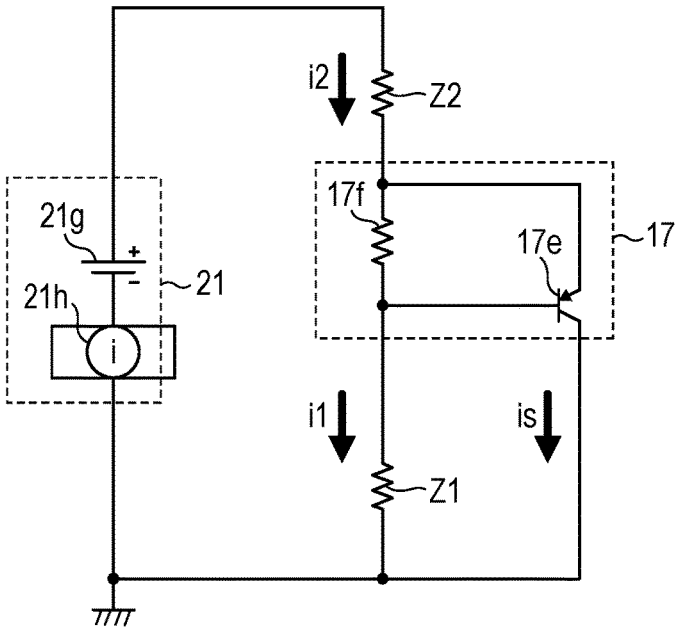
FIG. 5A is a schematic circuit diagram used for describing a current path of Embodiment 1.

Next, a current path from the secondary transfer power supply 21 will be described with reference to FIG. 5A. In FIG. 5A, the image forming apparatus illustrated in FIG. 1 is replaced with a simplified equivalent circuit, for a purpose of describing an electric circuit operation for the execution of the primary transfer. Here, to describe the current path in terms of direct current, a total impedance of the primary transfer units of the colors (four colors) is denoted by Z1, and an impedance of the secondary transfer unit is denoted by Z2. In FIG. 5A, a current path from the secondary transfer power supply 21 is illustrated as a current path of the secondary transfer current i2 formed when a positive voltage is applied to the secondary transfer roller 20. The secondary transfer power supply 21 includes a high-voltage power supply circuit 21*g* and the current detection circuit 21*h*.

The secondary transfer current i2 is branched off into a primary transfer current i1 and a surplus current is by an action of the current restriction circuit 17 described above. The primary transfer current i1 is the secondary transfer current i2 converted into a predetermined current value by the above-described resistor 17*f* of the current restriction circuit 17, flowing from the metal rollers 14*a* to 14*d* to the photosensitive drums 1*a* to 1*d*, and returning to the secondary transfer power supply 21. The surplus current is a difference of current (i2−i1) between the secondary transfer current i2 and the primary transfer current i1 flowing as a collector current of the transistor 17*e*, and then returning to the secondary transfer power supply 21. As seen from the above, since the secondary transfer current i2 flowing to the secondary transfer roller 20 matches a summed current of the primary transfer current i1 and the surplus current is (i2=i1+is), the secondary transfer current i2 flowing to the secondary transfer roller 20 can be detected by the current detection circuit 21*h*.

[Current Detection Circuit]

Next, the current detection circuit 21*h* will be described. In Embodiment 1, the transfer control unit 201 executes auto transfer voltage control (ATVC) on the secondary transfer roller 20. In the ATVC, the transfer control unit 201 causes the current detection circuit 21*h* to detect current that flows into the secondary transfer roller 20 when a secondary transfer positive voltage is applied to the secondary transfer roller 20. Here, the ATVC is to apply a predetermined voltage to the secondary transfer roller 20, to detect current flowing to the secondary transfer roller 20, and to control a voltage to be applied to the secondary transfer roller 20 in image formation based on a result of the detection of the current. A configuration of the current detection circuit 21*h* is similar to configurations disclosed in, for example, Japanese Patent Application Laid-Open No. 2013-078252 and the like, and will not be elaborated. The transfer control unit 201 can detect a value of the current flowing into the secondary transfer roller 20 based on the detection result from current detection circuit 21*h*.

[Current Control by Secondary Transfer Power Supply]

Next, the current control by the secondary transfer power supply 21 will be described. Let TB denote the amount of current flowing into the secondary transfer roller 20 and TA denote a total current amount necessary for executing the primary transfer satisfactorily. Here, the total current amount TA is a total amount of currents flowing into the primary transfer units (primary transfer unit of the four colors). The transfer control unit 201 executes the ATVC to apply the secondary transfer positive voltage to the secondary transfer roller 20, the secondary transfer positive voltage making the amount TB of the current flowing into the secondary transfer roller 20 satisfy a condition that the amount TB is larger than the total current amount TA (TB≥TA). The current amount TB satisfying the condition that the current amount TB is larger than the total current amount TA allows the above-described action of the current restriction circuit 17 of branching off the secondary transfer current i2 into the primary transfer current i1 and the surplus current is, enabling the predetermined primary transfer current i1 to flow into the primary transfer units. In this manner, the transfer control unit 201 is configured to control voltage to be applied to the secondary transfer roller 20 by the secondary transfer power supply 21. The transfer control unit 201 controls the secondary transfer power supply 21 so that the amount TB of the of current flowing into the secondary transfer roller 20 becomes larger than the predetermined current amount TA or larger, the predetermined current amount being needed to transfer toner images formed on the multiple photosensitive drums 1*a* to 1*d* on the intermediate transfer belt 10.

[Image Forming Operation]

Figure 5B:
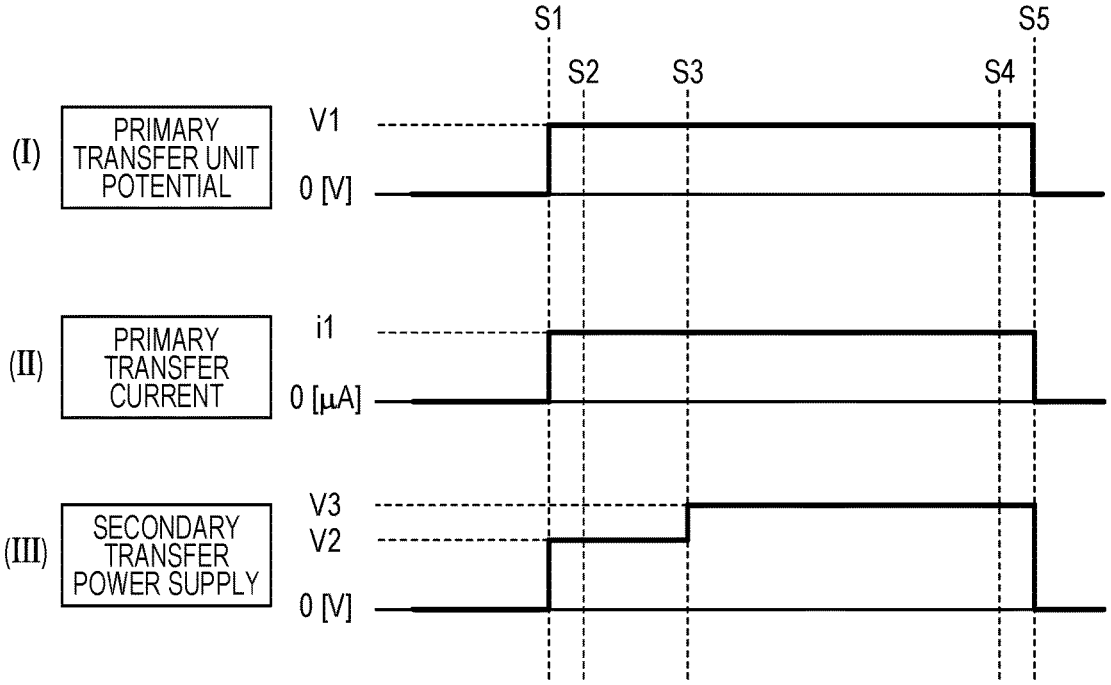
FIG. 5B is timing chart illustrating states of units in image formation.

Next, in the image forming operation in Embodiment 1, description will be made about a relation between the secondary transfer voltage, the potential of the primary transfer units, and the current flowing into the primary transfer units, in a course from start of the image forming operation, via the primary transfer, to completion of the secondary transfer, with reference to a timing chart of FIG. 5B. FIG. 5B (I) illustrates a potential of the primary transfer units, FIG. 5B (II) illustrates the primary transfer current flowing into the primary transfer units, and FIG. 5B (III) illustrates the voltage applied from the secondary transfer power supply 21 to the secondary transfer roller 20, where horizontal axes of the drawings all indicate time. S1 to S5 indicate timings.

In the image forming apparatus, the image forming operation is started by reception of an image signal from the controller 100. Before the primary transfer is started, at a timing S1, the transfer control unit 201 starts application of a voltage V2 from the secondary transfer power supply 21 to the secondary transfer roller 20. When the voltage V2 is applied to the secondary transfer roller 20, the secondary transfer current i2 flows from the secondary transfer roller 20 to the metal rollers 14*a* to 14*d* via the intermediate transfer belt 10 and the opposing roller 13, forming the potential V1 in the primary transfer units. To the current path from the opposing roller 13 to the metal rollers 14*a* to 14*d*, the current restriction circuit 17 is connected. The current restriction circuit 17 restricting the secondary transfer current i2 enables the primary transfer current i1 to flow into the primary transfer units. The primary transfer current i1 has a current value larger than a current value at which the predetermined transfer efficiency can be obtained. In Embodiment 1, the voltage V2 is set at 2000 V to allow the primary transfer current i1 to flow.

Subsequently, at timing S2, the primary transfer is started with the first image formation station a. Toner images are transferred one by one from the photosensitive drums 1*a* to 1*d* to the intermediate transfer belt 10. At timing S3, toners on the intermediate transfer belt 10 reach the secondary transfer unit, where the secondary transfer is performed. The transfer control unit 201 applies a voltage V3 to the secondary transfer roller 20 from the secondary transfer power supply 21, the voltage V3 being necessary for the secondary transfer. The transfer control unit 201 changes, at timing S3, the voltage output from the secondary transfer power supply 21 from the voltage V2 to the voltage V3. This change transfers the toner images on the intermediate transfer belt 10 on the recording material P, in the secondary transfer unit. The voltage V3 output from the secondary transfer power supply 21 in the secondary transfer is set at, for example, 2500 V. At the timing S3, the voltage applied from the secondary transfer power supply 21 is changed from the voltage V2 to the voltage V3, and the secondary transfer current i2 increases. Even in such a case, the primary transfer current i1 is kept constant by the action of the current restriction circuit 17.

Next, at timing S4, the primary transfer is terminated, and the secondary transfer is thereafter terminated at timing S5, so that the image forming operation is terminated. At timing S5, the transfer control unit 201 stops applying the voltage to the secondary transfer roller 20 from the secondary transfer power supply 21. This stop of application causes the secondary transfer current i2 and the primary transfer current i1 not to flow, so that the primary transfer potential becomes 0 V.

As seen from the above, the transfer control unit 201 controls the secondary transfer power supply 21 so that the voltage V2, which is a first voltage, is applied to the secondary transfer roller 20 before toner images formed on the respective multiple photosensitive drums 1*a* to 1*d* are transferred to the intermediate transfer belt 10. To transfer the toner images on the intermediate transfer belt 10 on the recording material P, the transfer control unit 201 controls the secondary transfer power supply 21 so that the voltage V3, which is a second voltage higher than the voltage V2, which is the first voltage, is applied to the secondary transfer roller 20.

As illustrated in FIG. 5B, the primary transfer current i1 flowing into the primary transfer units remains a constant current even when the transfer control unit 201 controls the voltage output from the secondary transfer power supply 21 to change to the voltage V2 and to the voltage V3, according to the image forming operation (FIG. 5B (II)). In this manner, the current restriction circuit 17 connected to the current path between the opposing roller 13 and the metal rollers 14*a* to 14*d* enables a predetermined current to flow into the primary transfer units. The predetermined current (primary transfer current i1) flowing from the current restriction circuit 17 to the metal rollers 14 transfers the toner images formed on the respective multiple photosensitive drums 1 on the intermediate transfer belt 10.

[Comparison Results]

Next, comparison results will be described. Table 1 shows a relation between the potential of the primary transfer units and current flowing into the primary transfer units in image formation, in Comparative Example 1 illustrated in FIG. 3 and Embodiment 1 illustrated in FIG. 1 described above.

TABLE 1

| Configuration | | Impedance of primary transfer units | | |
|---|---|---|---|---|
| | | 10 [MΩ] | 30 [MΩ] | 50 [MΩ] |
| Comparative example 1 | Primary transfer potential | 300 [V] | 300 [V] | 300 [V] |
| | Primary transfer current | 30 [μA] | 10 [μA] | 6 [μA] |
| Embodiment 1 | Primary transfer potential | 200 [V] | 600 [V] | 1000 [V] |
| | Primary transfer current | 20 [μA] | 20 [μA] | 20 [μA] |

Table 1 shows primary transfer potentials [V] and primary transfer currents [μA] in Comparative Example 1 and Embodiment 1. Table 1 also shows the primary transfer potentials and the primary transfer currents with the impedance of the primary transfer units being 10 MΩ, 30 MΩ and 50 MΩ.

In a configuration of Comparative Example 1, the primary transfer potential in the primary transfer units is at a constant voltage generated by the voltage maintaining element 15 irrespective of the impedance of the primary transfer units. Therefore, when the impedance of the primary transfer units fluctuates due to external factors such as environmental variations, the primary transfer current fluctuates. Since the primary transfer potential is constant, the primary transfer current is decreased with an increase in the impedance of the primary transfer units. If a proper primary transfer current cannot be ensured in the primary transfer units, toners in a required amount cannot be transferred to the intermediate transfer belt 10 from the photosensitive drums 1*a* to 1*d*. This failure to ensure the proper primary transfer current leads to a poor transfer such as poor density on an image fused on the recording material P.

For example, in the configuration of Comparative Example 1 (FIG. 3), assume that a predetermined potential of the voltage maintaining element 15 determining the primary transfer potential in the primary transfer units is 300 [V]. If the impedance Z1 of the primary transfer units fluctuates within a range from 10 [MΩ] to 50 [MΩ] due to external factors such as environmental variations, the primary transfer current undesirably fluctuates within a range from 6 [μA] to 30 [μA]. Accordingly, when the primary transfer current in the primary transfer units is excessively low, a transfer efficiency drops, resulting in occurrence of the poor transfer. Meanwhile, if the primary transfer current in the primary transfer units exceeds a predetermined amount, retransfer occurs in the primary transfer units, resulting in the occurrence of the poor transfer. As seen from the above, in a conventional configuration including the voltage maintaining element 15, it is difficult to ensure the primary transfer property and control the primary transfer current with stability, irrespective of environment.

In contrast, in a configuration of Embodiment 1 (FIG. 1), the current restriction circuit 17 is connected to the current path between the opposing roller 13 and the metal rollers 14, and a part of the current restriction circuit 17 is grounded. This configuration enables the predetermined primary transfer current to be kept in the primary transfer units. As shown in Table 1, in the configuration of Embodiment 1, the predetermined primary transfer current, 20 [μA] for example, is kept even when the impedance of the primary transfer units fluctuates.

As described above, according to Embodiment 1, the current restriction circuit 17 is connected in the current path between the opposing roller 13 and the metal rollers 14, and a part of the current restriction circuit 17 is grounded. This configuration suppresses the fluctuations in the primary transfer current, enabling a satisfactory primary transfer property to be ensured regardless of the fluctuations in impedance of the primary transfer units. In Embodiment 1, the configuration of the current restriction circuit 17 has a PNP transistor and a resistor. However, use can be made of other kinds of elements (e.g., an element such as MOSFET) as long as configurations of the circuit can provide the same effect, and such configurations will not be eliminated from the scope of the invention. In Embodiment 1, the metal rollers 14*a*, 14*b*, 14*c* and 14*d* being the contact members are provided on the photosensitive drums 1*a*, 1*b*, 1*c* and 1*d*, respectively. However, metal rollers are not necessarily provided in all of the photosensitive drums. As seen from the above, according to Embodiment 1, the primary transfer potential can be generated in such a manner that deals with fluctuations in the impedance of the primary transfer units.

Embodiment 2

Embodiment 1 is described such that the current restriction circuit 17 connected to the current path from the opposing roller 13 to the metal roller 14 suppresses the fluctuations in the primary transfer current, enabling a satisfactory primary transfer property to be ensured regardless of the fluctuations in impedance of the primary transfer units. In contrast, a feature of Embodiment 2 is that a resistive member such as a thermistor having a temperature coefficient of resistance is applied to the current restriction circuit 17. The rest of the configuration is similar to the configuration of the image forming apparatus in Embodiment 1, and description will be made with similar components denoted by like reference characters. In a case where fluctuations in the impedance of the primary transfer units are increased due to external factors such as environmental variations, Embodiment 2 aims at solving a problem in such a case in that a primary transfer current greatly changes due to an environment, a primary transfer property cannot be ensured, and a required toner amount cannot be transferred to an intermediate transfer belt.

[Difference in Current Restriction Circuit]

Figure 6:
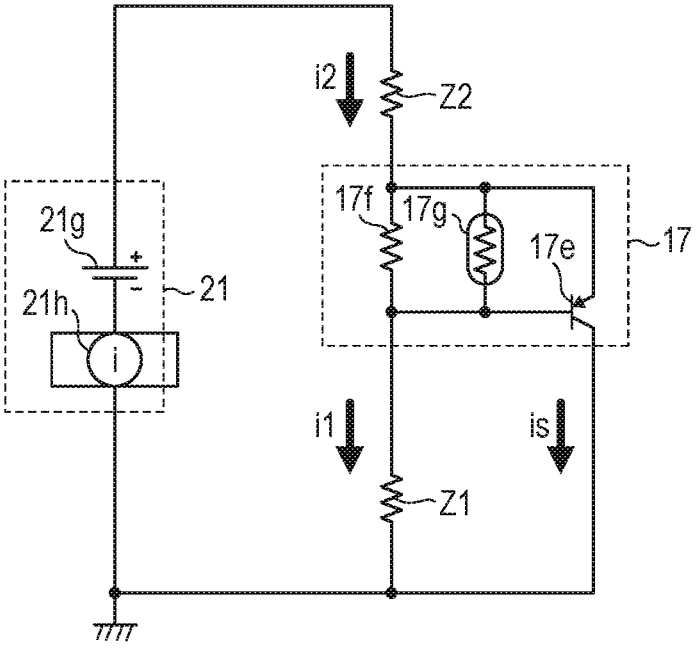
FIG. 6 is a schematic circuit diagram used for describing a configuration of a current restriction circuit of Embodiment 2.

The current restriction circuit 17 with a thermistor 17*g* added thereto will be described with reference to FIG. 6. It should be noted that components identical to those in FIG. 5A have the same reference characters and will not be described. In Embodiment 2, the current restriction circuit 17 includes a transistor 17*e* and a resistor 17*f*, as well as the thermistor 17*g*. The thermistor 17*g* is connected to the resistor 17*f* in parallel. An emitter terminal of the transistor 17*e* is connected to the opposing roller 13 and to a base terminal of the transistor 17*e* via the resistor 17*f* and the thermistor 17*g*. A collector terminal of the transistor 17*e* is grounded. Here, a combined resistance value of the resistor 17*f* and the thermistor 17*g* is denoted by Rx.

More in detail, the resistor 17*f* includes one end connected to the opposing roller 13 and another end connected to the metal rollers 14. The thermistor 17*g* includes one end connected to the opposing roller 13 and one end of the resistor 17*f*, and another end connected to the metal rollers 14 and the other end of the resistor 17*f*. In the transistor 17*e*, the emitter terminal is connected to the opposing roller 13, the one end of the resistor 17*f*, and the one end of the thermistor 17*g*, the base terminal is connected to the metal rollers 14, the other end of the resistor 17*f*, and the other end of the thermistor 17*g*, and the collector terminal is grounded.

In the current restriction circuit 17, when a secondary transfer current i2 flows from the secondary transfer roller 20 being the current supply member, voltage is applied between the base terminal and the emitter terminal of the transistor 17*e*, and current flows into the base terminal of the transistor 17*e*. Here, a current i1 flowing through the resistor 17*f* and the thermistor 17*g* is expressed by Formula (2) below using a base-emitter voltage Vbe of the transistor 17, a resistance value R1 of the resistor 17*f*, and a resistance value Rth of the thermistor 17*g*.

$$i1=Vbe/\{(R1\times Rth)/(R1+Rth)\}=Vbe/Rx \quad (2)$$

Here, a base current in the transistor 17*e* is a current sufficiently small as compared with the secondary transfer current i2, and the current i1 calculated by Formula (2) can be regarded as a total of values of currents flowing into metal rollers 14*a*, 14*b*, 14*c* and 14*d*. The current i1 will hereafter be referred to as a primary transfer current i1.

[Advantageous Effect of Embodiment 2]

Next, an advantageous effect of Embodiment 2 will be described. Description will be made below about a case of intending to increase the primary transfer current i1 with an increase in atmosphere temperature, by way of example. In this case, it is understood from Formula (2) that the combined resistance value Rx of the resistor 17*f* and the thermistor 17*g* may be reduced according to an atmosphere temperature. As the thermistor 17*g*, use is therefore to be made of a negative temperature coefficient (NTC) thermistor, which has a negative temperature characteristic. The thermistor 17*g* is a thermistor a resistance value of which decreases with an increase in temperature.

Here, assuming that a resistance value of the NTC thermistor is R0 [kΩ] at a temperature T0 [° C.], a resistance value Rth [kΩ] of the NTC thermistor at a temperature T [° C.] is typically expressed by Formula (3) below.

$$Rth=R0\times\exp(B\times((1/(T+273))-(1/(T0+273))))) \quad (3)$$

Assume that the resistance value R1 of the resistor 17*f* is 1 [MΩ]. With parameters of the thermistor 17*g* given as follows: B value: 3500 [K], temperature T0=25 [° C.], and resistance value R0=33 [kΩ], Formula (2) and Formula (3) provide temperature characteristics of the primary transfer current i1 illustrated in FIG. 7.

Figure 7:
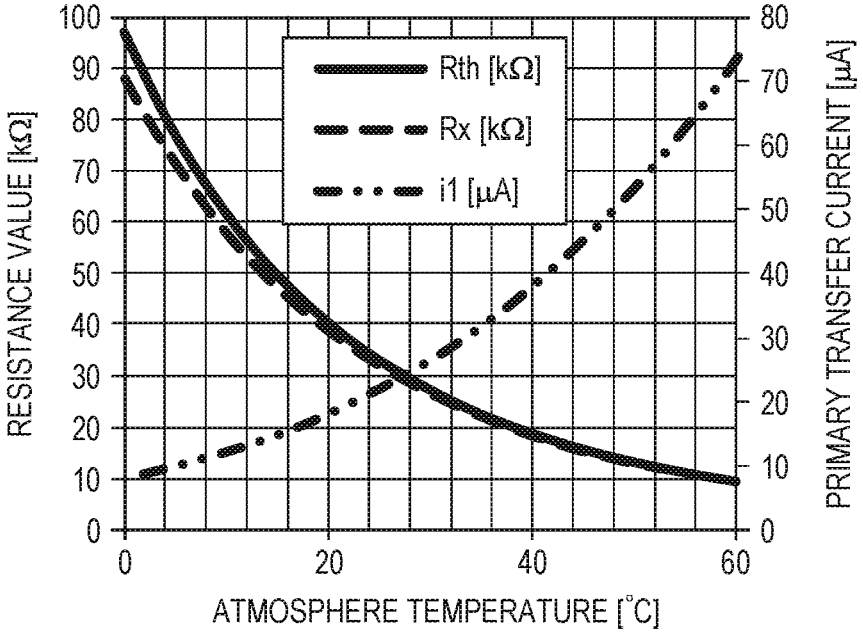
FIG. 7 is a graph used for describing a relation among an atmosphere temperature, a resistance value, and a primary transfer current, in Embodiment 2.

FIG. 7 is a graph in which a horizontal axis represents the atmosphere temperature [° C.], a left vertical axis represents the resistance value [kΩ], and a right vertical axis represents the primary transfer current [μA]. In FIG. 7, a solid line indicates the resistance value Rth [kΩ] of the thermistor 17*g*. The resistance value Rth of the thermistor 17*g* decreases as the atmosphere temperature rises. In FIG. 7, a broken line indicates the combined resistance value Rx of the resistor 17*f* and the thermistor 17*g*. The combined resistance value Rx decreases as the atmosphere temperature rises. In FIG. 7, a chain double-dashed line indicates the primary transfer current i1. The primary transfer current i1 increases as the atmosphere temperature rises. As seen from the above, the primary transfer current i1 to flow into the metal rollers 14*a*, 14*b*, 14*c* and 14*d* is set at 12, 22 and 38 [μA] when the atmosphere temperature is 10, 25 and 40 [° C.], respectively.

As described above, according to Embodiment 2, adding and connecting the thermistor 17*g* to the current restriction circuit 17 in Embodiment 1 enables automatic adjustment of the primary transfer current i1 according to the atmosphere temperature. In Embodiment 2, use is made of an NTC thermistor as a resistive member having a temperature coefficient of resistance. However, use can be made of other kinds of elements as long as configurations of the circuit can provide the same effect, and such configurations will not be eliminated from the scope of the invention. The current restriction circuit 17 has the configuration in which the resistor 17*f* is connected to the thermistor 17*g* in parallel. However, the configuration does not necessarily include the resistor 17*f* as long as configurations of the circuit can provide the same effect, and such configurations will not be eliminated from the scope of the invention. As seen from the above, according to Embodiment 2, the primary transfer potential can be generated in such a manner that deals with fluctuations in the impedance of the primary transfer units.

Embodiment 3

Embodiments 1 and 2 are described such that the current restriction circuit 17 connected to the current path from the opposing roller 13 to the metal roller 14 suppresses the fluctuations in the primary transfer current, enabling a satisfactory primary transfer property to be ensured regardless of the fluctuations in impedance of the primary transfer units. In contrast, a feature of Embodiment 3 is that a voltage maintaining element is additionally connected to an opposing roller 13. The rest of the configuration is similar to the configuration of the image forming apparatus in Embodiment 1, and description will be made with similar components denoted by like reference characters. A current restriction circuit 17 may have the configuration of Embodiment 1 or the configuration of Embodiment 2.

[Overview of Secondary Transfer Opposing Roller]

Figure 8:
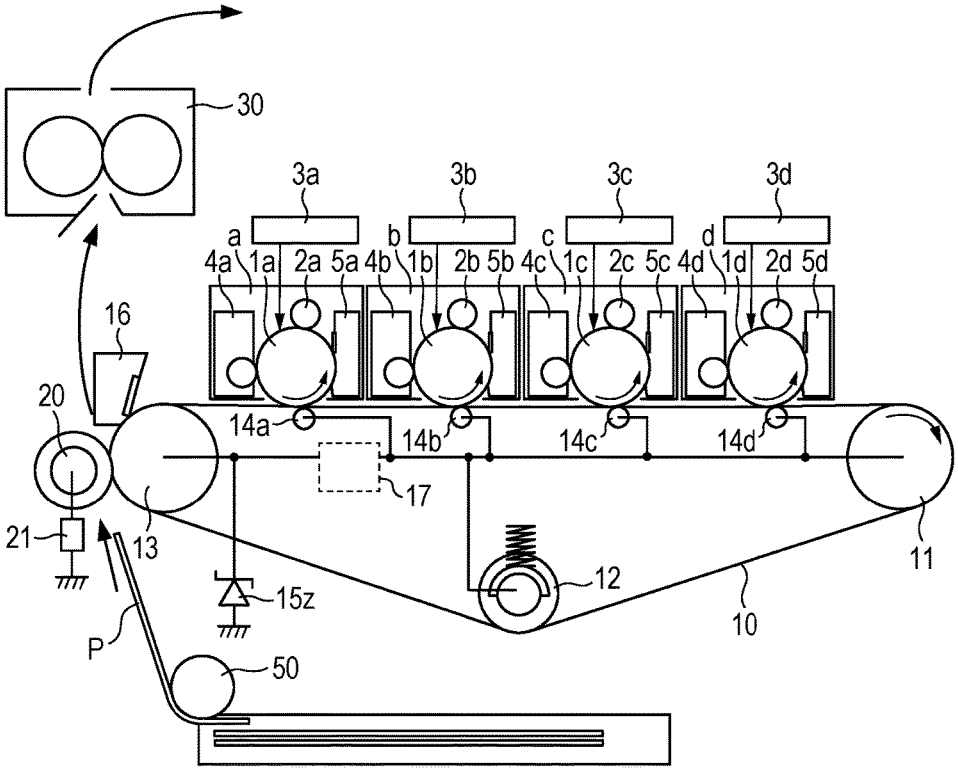
FIG. 8 is a schematic diagram used for describing an image formation apparatus of Embodiment 3.

A configuration of Embodiment 3 will be described below with reference to FIG. 8. An intermediate transfer belt 10 is tensioned by three shafts: a drive roller 11, a tension roller 12, and the opposing roller 13, which are tensioning members. As illustrated in FIG. 8, in Embodiment 3, the opposing roller 13 is connected to a Zener diode 15*z*, which is a constant voltage element and a voltage maintaining element, and is grounded via the Zener diode 15*z*, on an anode side of the Zener diode 15*z*. More in detail, the Zener diode 15*z* is an element connected to a current path between the opposing roller 13 and the current restriction circuit 17 and being for maintaining a voltage at a predetermined voltage.

The Zener diode 15z includes a cathode side connected to the current path from the opposing roller 13 to the current restriction circuit 17 and the anode side grounded.

[Method for Generating Secondary Transfer Opposing Roller Potential]

Next, a method for generating a potential of the opposing roller 13 will be described in detail in comparison with Embodiment 1. In Embodiment 1 (FIG. 1), the opposing roller 13 is connected to the current restriction circuit 17. The opposing roller 13 to which the current restriction circuit 17 is connected is maintained at a primary transfer potential generated by current flowing an impedance Z1 of primary transfer units. However, in a case where, for example, the impedance Z1 of the primary transfer units temporarily increases due to environmental variations, if the primary transfer current i1 in the primary transfer units is constant, the primary transfer potential and the potential of the opposing roller 13 undesirably increase in proportion to the impedance Z1 of the primary transfer units. For that reason, to maintain a potential of the secondary transfer unit, the transfer control unit 201 needs to further increase a secondary transfer positive voltage to be applied to the secondary transfer roller 20 according to fluctuations in the impedance Z1 of the primary transfer units. This necessity results in an increase in a power supply capacity of a secondary transfer power supply 21 and raises a problem in that compatibility between a primary transfer property and a secondary transfer property becomes difficult regardless of environment.

Hence, Embodiment 3 has a configuration in which a proper primary transfer current for the primary transfer units is supplied with stability regardless of environment, and at the same time, when the impedance Z1 of the primary transfer units temporarily increases, control is executed as follows. That is, to maintain the potential of the opposing roller 13 at a predetermined potential or lower, the opposing roller 13 is grounded via the Zener diode 15z, which is a constant voltage element and a voltage maintaining element, as illustrated in FIG. 8. Assume that a Zener voltage of the Zener diode 15z is set at 1000 V. The Zener diode 15z is configured to suppress the potential of the opposing roller 13 to a given potential. This suppression allows the configuration to avoid an increase in the power supply capacity of the secondary transfer power supply 21 and at the same time to generate a proper potential for the secondary transfer unit irrespective of fluctuations in the impedance caused due to factors bringing about in the primary transfer units.

Table 2 shows a relation among the potential of the opposing roller 13, the potential of the secondary transfer unit, and the secondary transfer positive voltage, in Embodiment 1 and Embodiment 3.

TABLE 2

| Configuration * Assuming primary transfer current to be 20 [μA] | | Impedance of primary transfer units 10 [MΩ] | 30 [MΩ] | 200 [MΩ] |
|---|---|---|---|---|
| Embodiment 1 | Secondary transfer opposing roller potential | 200 [V] | 1000 [V] | 4000 [V] |
| | Secondary transfer member potential | 1000 [V] | 1000 [V] | 1000 [V] |
| | Secondary transfer positive voltage | 1200 [V] | 2000 [V] | (5000 [V]) |
| Embodiment 3 | Secondary transfer opposing roller potential | 200 [V] | 1000 [V] | 1000 [V] |
| | Secondary transfer member potential | 1000 [V] | 1000 [V] | 1000 [V] |
| | Secondary transfer positive voltage | 1200 [V] | 2000 [V] | 2000 [V] |

Here, the primary transfer current is assumed to be 20 [μA]. Table 2 shows the potentials and the voltage with the impedance of the primary transfer units being 10 MΩ, 30 MΩ and 50 MΩ. The secondary transfer positive voltage is a total of the potential of opposing roller 13 and the potential of the secondary transfer unit.

In Embodiment 3, to reduce in size of the image forming apparatus, the secondary transfer power supply 21 is assumed to be a high-voltage power supply capable of outputting a voltage range from 100 to 4000 [V]. As shown in Table 2, in Embodiment 1, when satisfaction of an optimal primary transfer current is intended, the potential of the opposing roller 13 increases with an increase in the impedance of the primary transfer units. For example, when the impedance of the primary transfer units is 200 [MΩ], the potential of the opposing roller 13 is 4000 [V]. To cause a primary transfer current of 20 [μA] to flow when the impedance of the primary transfer units is 200 [MΩ], the secondary transfer power supply 21 has to output a secondary transfer positive voltage of 5000 [V]. Such a voltage cannot be supported by the secondary transfer power supply 21 capable of outputting a voltage within a range from 1000 to 4000 [V], and there may arise a risk of increasing the power supply capacity.

In contrast, the configuration of Embodiment 3 includes the Zener diode 15z connected to the current path from the opposing roller 13 to the current restriction circuit 17. This configuration maintains the potential of the opposing roller 13 at a predetermined potential (1000 V) or lower and enables a proper potential to be generated in the secondary transfer unit irrespective of the impedance of the primary transfer units. For example, as shown in Table 2, when the impedance of the primary transfer units is 200 [MΩ], the potential of the opposing roller 13 is 1000 [V]. To cause a primary transfer current of 20 [μA] to flow when the impedance of the primary transfer units is 200 [MΩ], the secondary transfer power supply 21 may output a secondary transfer positive voltage of 2000 [V]. With this configuration, even the secondary transfer power supply 21 capable of outputting a voltage within a range from 1000 to 4000 [V] can support the voltage, eliminating the risk of increasing the power supply capacity.

As described above, according to Embodiment 3, the voltage maintaining element is connected to the opposing roller 13. This configuration maintains the potential of the opposing roller 13 at a predetermined potential and enables a proper potential to be generated in the secondary transfer unit while avoiding the increase in the power supply capacity of the secondary transfer power supply 21, irrespective of various fluctuations in the impedance occurring in the primary transfer units. As seen from the above, according to Embodiment 3, the primary transfer potential can be generated in such a manner that deals with fluctuations in the impedance of the primary transfer units.

Embodiment 4

Embodiment 1 to Embodiment 3 are described such that the current restriction circuit 17 is employed, and a potential having a positive polarity is generated in the intermediate transfer belt 10 and the metal rollers 14. In Embodiment 4, a smoothing element is additionally connected to a current restriction circuit, enabling an intermediate transfer belt 10 and metal rollers 14 connected to the smoothing element to have a potential of a negative polarity.

Figure 9:
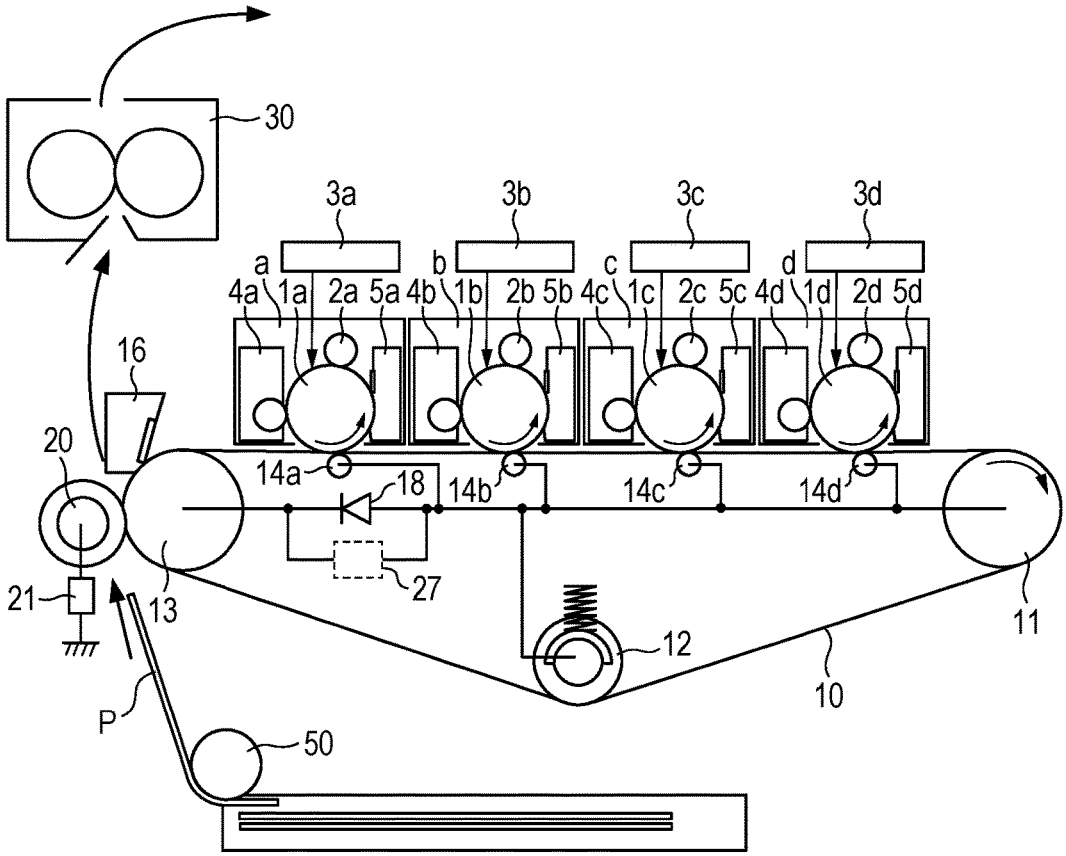
FIG. 9 is a schematic diagram used for describing an image formation apparatus of Embodiment 4.

FIG. 9 is a schematic diagram illustrating an example of an image forming apparatus in Embodiment 4. A smoothing element 18 is added to a current restriction circuit 27. The rest of the configuration is similar to the configuration of the image forming apparatus in Embodiment 1, and description will be made with similar components denoted by like reference characters. In Embodiment 4, a diode 18 being a smoothing element includes a cathode side connected to an opposing roller 13 and an anode side connected to the metal rollers 14. This configuration forms a bypass route allowing current to flow from the metal rollers 14 to the opposing roller 13 when a secondary transfer negative voltage is applied to a secondary transfer roller 20. This bypass route enables the intermediate transfer belt 10 and the metal rollers 14 to have a potential with a negative polarity.

[Difference in Current Restriction Circuit]

Next, with reference to FIG. 10A and FIG. 10B, description will be made about differences in the current restriction circuit 27 bringing about with the addition of the bypass route with the smoothing element 18 interposed therein. In Embodiment 4, the current restriction circuit 27 includes a transistor 27*e*, a resistor 27*f*, as well as a diode 27*g* and a resistor 27*h*. An emitter terminal of the transistor 27*e* is connected to the opposing roller 13 and to a base terminal of the transistor 27*e* via the resistor 27*f*. A collector terminal of the transistor 27*e* is connected to an anode side of the diode 27*g*, and a cathode side of the diode 27*g* is grounded. The resistor 27*h* is connected between the emitter terminal and the collector terminal of the transistor 27*e*.

In Embodiment 4, the secondary transfer power supply 21 is capable of applying a voltage of a positive polarity and a voltage of a negative polarity, to the secondary transfer roller 20. The diode 18 being a first smoothing element includes a cathode terminal connected to the opposing roller 13 and an anode terminal connected to the metal rollers 14 and is connected to the current restriction circuit 27 in parallel. The current restriction circuit 27 includes the resistor 27*f* being a first resistor element including one end connected to the opposing roller 13 and another end connected to the metal rollers 14. The current restriction circuit 27 includes the transistor 27*e*. The transistor 27*e* includes an emitter terminal connected to the opposing roller 13 and the one end of the resistor 27*f*, a base terminal connected to the metal rollers 14 and the other end of the resistor 27*f*, and a collector terminal grounded via the diode 27*g* being a second smoothing element. The current restriction circuit 27 includes the resistor 27*h* being a second resistor element connected between the emitter terminal and the collector terminal of the transistor. The current restriction circuit 27 further includes the diode 27*g*, and an anode terminal of the diode 27*g* is connected to the other end of the resistor 27*h* and the collector terminal of the transistor 27*e*, and a cathode terminal of the diode 27*g* is grounded.

Figure 10A:
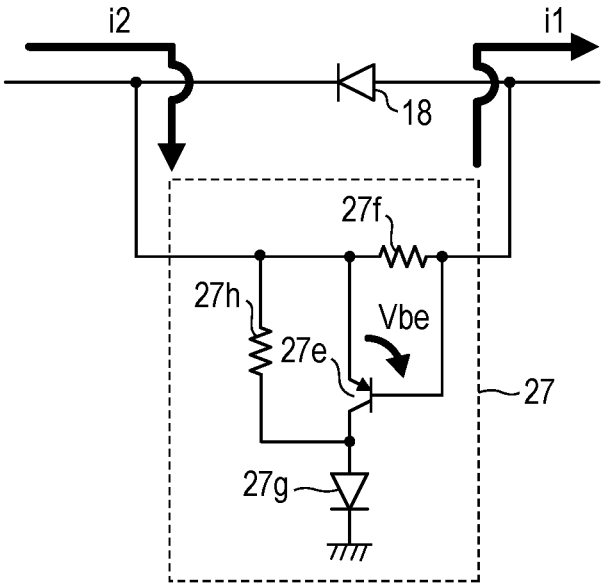
FIG. 10A and FIG. 10B are schematic circuit diagrams used for describing a configuration of a current restriction circuit of Embodiment 4.
Figure 10B:
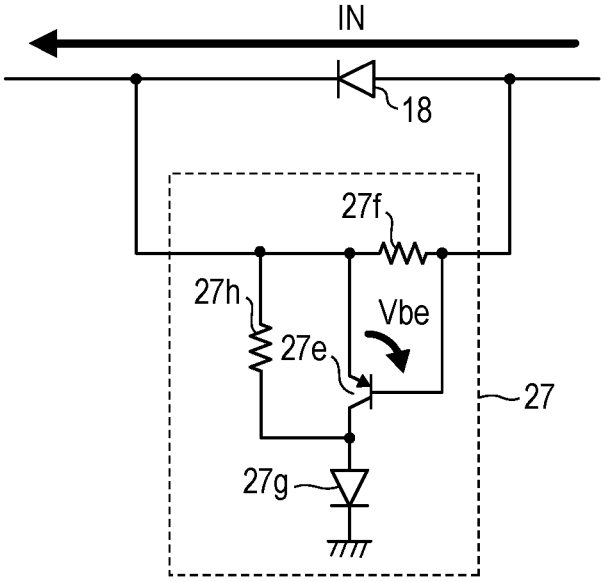

FIG. 10A is a schematic diagram used for describing a case where the potential of the intermediate transfer belt 10 is kept at a positive polarity. When a secondary transfer positive voltage is applied to the secondary transfer roller 20, a secondary transfer current i2 flows from the opposing roller 13 to the current restriction circuit 27. At this point, in the diode 18, a potential of the cathode side becomes higher than a potential of the anode side. Therefore, a reverse-direction voltage is applied to the diode 18. In this manner, since a voltage is applied to the diode 18 in a reverse direction, no current flows through the diode 18. Therefore, when the secondary transfer positive voltage is applied to the secondary transfer roller 20, the current restriction circuit 27 operates in the same manner as the current restriction circuit 17 described in Embodiment 1.

Meanwhile, when the secondary transfer negative voltage is applied to the secondary transfer roller 20, a negative current iN flows from the metal rollers 14 to the current restriction circuit 27. FIG. 10B is a schematic diagram used for describing a case where the potential of the intermediate transfer belt 10 is kept at a negative polarity. At this point, in the diode 18, the potential of the anode side becomes higher than the potential of the cathode side. Therefore, a forward voltage is applied to the diode 18. In this manner, a voltage is applied to the diode 18 in a forward direction, forming a bypass route allowing current to flow from the metal rollers 14 to the opposing roller 13 via the diode 18. The diode 27*g* and the resistor 27*h* are elements for protecting the transistor 27*e* by preventing a reverse voltage from being applied to between the emitter terminal and the collector terminal of the transistor 27*e* when the negative current iN flows through the diode 18 forming the bypass route.

[Method for Generating Negative Potential in Intermediate Transfer Belt]

Description will be made below about a case of maintaining the potential of the intermediate transfer belt 10 at a negative polarity, with reference to FIG. 10B. For example, to clean the intermediate transfer belt 10, toner having a negative polarity and adhered to the intermediate transfer belt 10 is caused to move to the photosensitive drums 1*a* to 1*d*. When it is intended to move the toner having a negative polarity from the intermediate transfer belt 10 to the photosensitive drums 1*a* to 1*d*, the potential of the intermediate transfer belt 10 needs to be maintained at a negative polarity.

The application of a voltage of a negative polarity from the secondary transfer power supply 21 to the secondary transfer roller 20 forms the following route of a negative current. That is, the formed route of a negative current starts from GNDs (not illustrated) of the photosensitive drums 1, passes through the metal rollers 14, the diode 18, the opposing roller 13, the intermediate transfer belt 10, and the secondary transfer roller 20, and returns to the secondary transfer power supply 21. Assume that the voltage of a negative polarity applied from the secondary transfer power supply 21 to the secondary transfer roller 20 is, for example, −1000 [V]. This route enables the intermediate transfer belt 10 contacting the metal rollers 14 to have a negative potential.

As described above, according to Embodiment 4, the diode 18 being a smoothing element is added to the current restriction circuit 27, and the cathode side of the diode 18 is connected to the opposing roller 13, and the anode side of the diode 18 is connected to the metal rollers 14. The current restriction circuit 27 includes the diode 27*g* and the resistor 27*h* so as to protect the transistor 27*e* by preventing a reverse potential from being generated between the emitter terminal and the collector terminal. This configuration forms a bypass route allowing current to flow from the metal rollers 14 to the opposing roller 13 via the diode 18 when a secondary transfer negative voltage is applied to a secondary transfer roller 20. This bypass route enables the intermediate transfer belt 10 contacting the metal rollers 14 to have a negative potential. To the current path between the opposing roller 13 and the current restriction circuit 27 of Embodiment 4, the Zener diode 15*z* of the Embodiment 3 may be connected. As seen from the above, according to Embodiment 4, the primary transfer potential can be generated in such a manner that deals with fluctuations in the impedance of the primary transfer units.

Embodiment 5

Embodiment 1 to Embodiment 4 are described such that use is made of the secondary transfer roller 20 as a current supply member, and current is supplied from the secondary transfer roller 20 to the intermediate transfer belt 10. In contrast, a feature of Embodiment 5 is that use is made of the secondary transfer roller 20 as well as another conductive member as a current supply member from which current is supplied to the intermediate transfer belt 10. Specifically, a feature of Embodiment 5 is that, as the conductive member, use is made of a charge member for removing toner residing on the intermediate transfer belt 10 after the secondary transfer. The rest of the configuration is similar to the configuration of the image forming apparatus in Embodiment 1, and description will be made with similar components denoted by like reference characters.

Figure 11A:
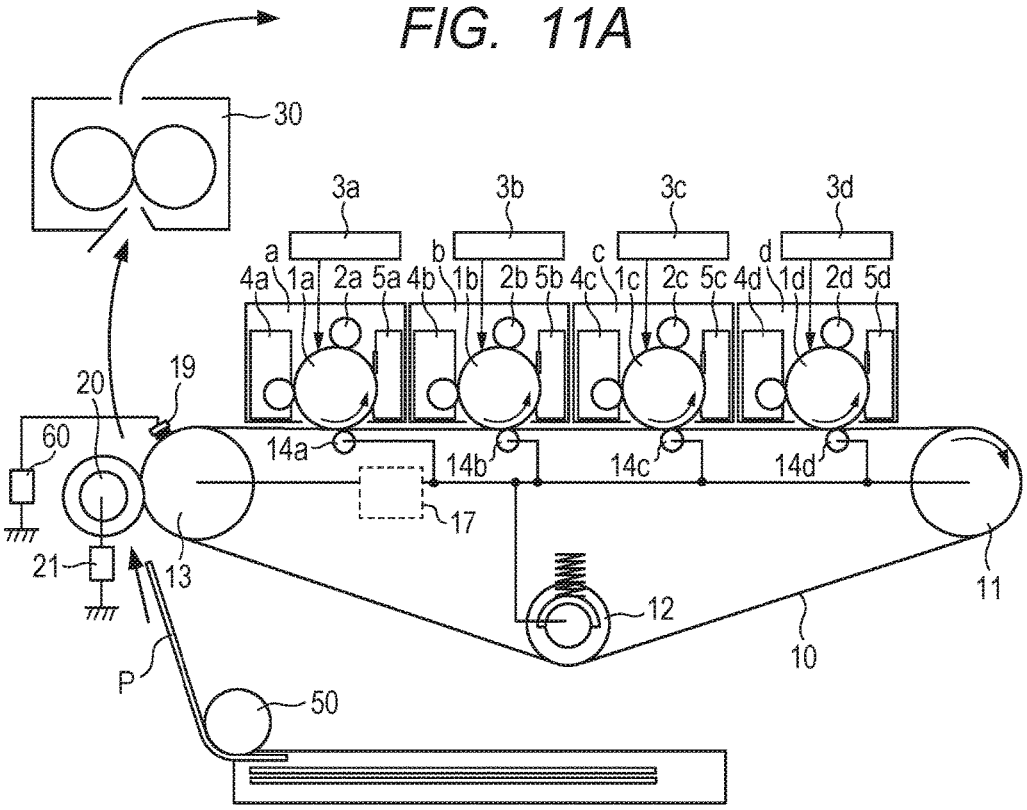
FIG. 11A is a schematic diagram used for describing an image formation apparatus of Embodiment 5.

FIG. 11A is a schematic diagram used for describing an image forming apparatus in Embodiment 5. The image forming apparatus of Embodiment 5 uses a conductive brush member 19 as a charge member to collect toner residing on the intermediate transfer belt 10 in place of the cleaning device 16 of the image forming apparatus of Embodiment 1. The toner residing on the intermediate transfer belt 10 after the secondary transfer is charged by the brush member 19 being a charge member. The brush member 19 is made of a conductive fiber. To the brush member 19, a predetermined voltage is applied from a high-voltage power supply 60 being a charge power supply, so that the toner residing after the secondary transfer is charged. In Embodiment 5, a regular charged polarity of toners housed in the developing devices is a negative polarity. Accordingly, a voltage of a positive polarity is applied to the brush member 19 from the high-voltage power supply 60, so as to charge the toners to have a positive polarity. The brush member 19 is made of a conductive fiber. The brush member 19 is configured to charge toner by the application of the predetermined voltage from the high-voltage power supply 60. When a voltage is applied to the brush member 19 by the high-voltage power supply 60, current flows from the brush member 19 to the current restriction circuit 17 via the intermediate transfer belt 10 and the opposing roller 13.

[Cleaning Intermediate Transfer Belt]

Next, a method for cleaning the intermediate transfer belt 10 will be described. In Embodiment 5, toners are charged to have a negative polarity in developing devices 4*a*, 4*b*, 4*c* and 4*d*, thereafter developed in the photosensitive drums 1*a*, 1*b*, 1*c* and 1*d*, and transferred to the intermediate transfer belt 10 in the primary transfer units. The secondary transfer roller 20 to which the positive polarity voltage is applied from the secondary transfer power supply 21 thereafter performs the secondary transfer on a recording material P such as paper, so as to form an image. Toner residing on the intermediate transfer belt 10 after the secondary transfer is easily charged to have a positive polarity under an influence of the voltage of a positive polarity applied to the secondary transfer roller 20. As a result, the toner residing after the secondary transfer has positive and negative polarities intermixedly. The toner residing after the secondary transfer may locally accumulate in a form of multiple layers, residing on the intermediate transfer belt 10, under an influence of unevenness on the surface of the recording material P.

The brush member 19 is disposed in such a manner as to be fixed relatively to the intermediate transfer belt 10 rotary moving and disposed in such a manner as to enter the intermediate transfer belt 10 by a predetermined intrusion amount. The brush member 19 is supported in the image forming apparatus and does not rotate while the intermediate transfer belt 10 moves. Therefore, when toner passes through a charge unit formed by the brush member 19 and the intermediate transfer belt 10, the toner accumulating on the intermediate transfer belt 10 in a form of multiple layers is mechanically scattered to be substantially as high as one layer, by a difference in circumferential speed between the brush member 19 and the intermediate transfer belt 10. To the brush member 19, the voltage of a positive polarity is applied from the high-voltage power supply 60, and constant current control is executed. When the toner residing after the secondary transfer passes through the charge unit, the toner is charged to have a positive polarity being a reversed polarity to a polarity of the toner in the development. The toner having a negative polarity not having completely been charged to have a positive polarity is collected by the brush member 19.

The toner having an optimal charge given by the brush member 19 thereafter moves to the photosensitive drum 1*a* charged to have a negative polarity in the primary transfer unit. The toner having moved from the intermediate transfer belt 10 to the photosensitive drum 1*a* is collected by a cleaning device 5*a* disposed on the photosensitive drum 1*a*. The movement of the toner charged to have a positive polarity from the intermediate transfer belt 10 to the photosensitive drum 1*a* may be performed at a timing the same as a timing of transferring a toner image from the photosensitive drum 1*a* to the intermediate transfer belt 10 (simultaneously with the transfer) or may be performed at a time different from the timing of transferring. As seen from the above, a feature of Embodiment 5 is that use is made of the secondary transfer roller 20 as well as the conductive brush member 19 being a charge member, as a current supply member. The reason for using the conductive brush member 19 will be described below.

[Roles of Current Supply Members in Image Formation]

In Embodiment 1 to Embodiment 3, the secondary transfer roller 20 has two roles. One of the roles is to flow a predetermined current amount for the secondary transfer so as to satisfy the secondary transfer property. Another one of the roles is to flow a predetermined current amount for the primary transfer to the photosensitive drums 1 so as to maintain a potential of the intermediate transfer belt 10 in the respective primary transfer units. Therefore, in Embodiment 1, the predetermined current amount for the secondary transfer and the predetermined current amount for the primary transfer need to be supplied only from the secondary transfer roller 20 as a current supply member.

Here, a relation between the predetermined current amount for the secondary transfer and the predetermined current amount for the primary transfer will be described. The predetermined current amount for the secondary transfer is desirably set at a current value such that optimizes a transfer efficiency for a recording material P in the secondary transfer unit. In Embodiment 5, a current amount optimal for the secondary transfer is assumed to be, for example, 15 μA. Meanwhile, the predetermined current amount for the primary transfer is desirably set at a current value such that optimizes a transfer efficiency for the intermediate transfer belt 10 in the primary transfer units. In Embodiment 5, a current amount optimal for the primary transfer is assumed to be, for example, 20 μA. From the above, letting a current amount TA denote an amount of current necessary to execute the primary transfer suitably, and a current amount TB denote an amount of current supplied to the intermediate transfer belt 10, a predetermined primary transfer performance can be obtained when a condition that the current amount TB is equal to or higher than the current amount TA is satisfied.

However, when it is intended to supply the current amount TB from only the secondary transfer roller 20, a current amount of 20 μA or larger needs to be supplied, and the current amount is larger than a current amount of 15 μA with which the secondary transfer property takes an optimal value. As in Embodiment 1, when it is intended to supply current from only the secondary transfer roller 20, the predetermined primary transfer performance needs to be obtained by increasing the amount of current to be supplied to the secondary transfer roller 20 within a tolerable range of a secondary transfer performance. Hence, in Embodiment 5, additional use of the brush member 19 as a current supply member enables the amount of current supplied from the secondary transfer roller 20 to be set optimal for the predetermined current amount for the secondary transfer and at the same time enables the primary transfer property to be satisfied.

The transfer control unit 201 is configured to control the voltage applied to the secondary transfer roller 20 by the secondary transfer power supply 21 and the voltage applied to the brush member 19 by the high-voltage power supply 60. A total of the amount of current flowing through the secondary transfer roller 20 and the amount of current flowing through the brush member 19 is controlled to be a predetermined current amount or larger required for transferring toner images formed on the multiple photosensitive drums 1*a* to 1*d* on the intermediate transfer belt 10 (TB≥TA).

[Secondary Transfer Power Supply and Current Control]

Next, description will be made about a current control over the secondary transfer power supply 21 being a first application unit and the high-voltage power supply 60 being a charge power supply. Specifically, a controller 100 being a control unit is configured to control the secondary transfer power supply 21 and the high-voltage power supply 60, so as to supply current from the secondary transfer roller 20 and the brush member 19 to the intermediate transfer belt 10. As described above, a current necessary for the primary transfer is 20 μA. Therefore, when a summed current of a current flowing from the brush member 19 and a current flowing from the secondary transfer roller 20 is 20 μA or larger, a potential necessary for the primary transfer is retained. Hence, supplying a current of 5 μA or larger from the brush member 19 makes the summed current 20 μA or larger even when the current supplied from the secondary transfer roller 20 is 15 μA, and the secondary transfer and the primary transfer can be executed satisfactorily.

[Image Forming Operation]

Figure 11B:
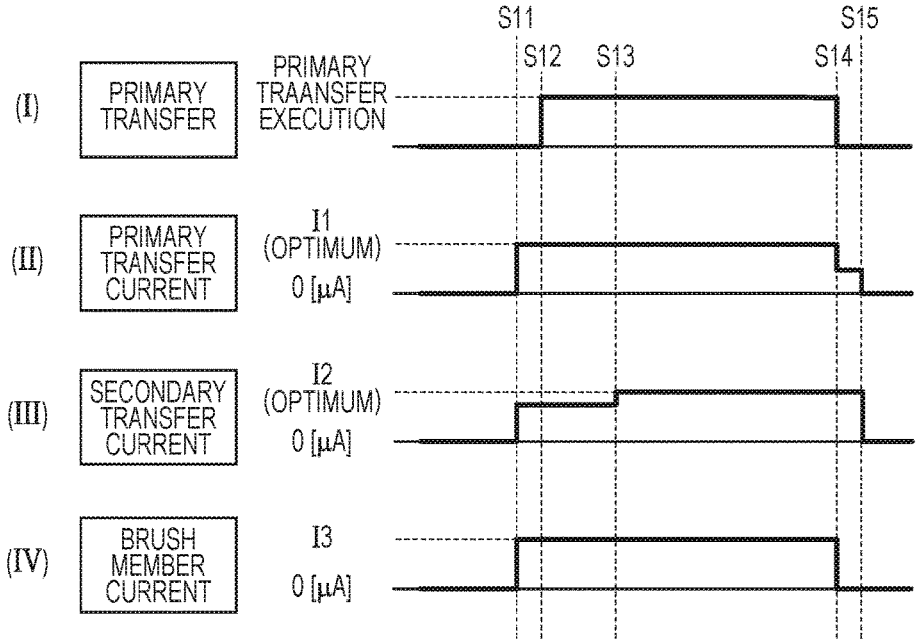
FIG. 11B is a timing chart illustrating states of units in image formation.

Next, in the image forming operation in Embodiment 5, description will be made about a relation between the secondary transfer voltage, the potential of the primary transfer units, and the current flowing into the primary transfer units, in a course from start of the image forming operation, via the primary transfer, to completion of the secondary transfer, with reference to a timing chart of FIG. 11B. FIG. 11B (I) illustrates execution of the primary transfer. FIG. 11B (II) illustrates the primary transfer current flowing into the primary transfer units, where a current optimal for the primary transfer is denoted by I1. FIG. 11B (III) illustrates a secondary transfer current supplied from the secondary transfer roller 20 when the secondary transfer voltage is applied to the secondary transfer roller 20 from the secondary transfer power supply 21, where a current optimal for the secondary transfer is denoted by 12. FIG. 11B (IV) illustrates a current supplied from the brush member 19 when a voltage is applied to the brush member 19 from the high-voltage power supply 60, where the current at this point is denoted by 13. S11 to S15 indicate timings. As described above, assume that the current optimal for the primary transfer is 20 μA, and the current optimal for the secondary transfer is 15 μA. Additionally, assume that a current flowing into the brush member 19 is 5 μA or larger, for example, 7 μA.

The image forming operation is started by the controller 100 outputting an image signal. Before the primary transfer is started, at a timing S11, application of the voltage V2 from the secondary transfer power supply 21 to the secondary transfer roller 20 is started under control of the transfer control unit 201. Assume that, for example, 13 μA is set to a current flowing through the secondary transfer roller 20 as voltage is applied to the secondary transfer roller 20 from the secondary transfer power supply 21. This setting causes a current supply from the secondary transfer roller 20 to the primary transfer units to be started. At timing S11, a current supply to the primary transfer units is started also from the brush member 19. At timing S11, a current of 13 μA is supplied from the secondary transfer roller 20, and a current of 7 μA is supplied from the brush member 19. Therefore, an optimal primary transfer current of, for example, 20 μA is supplied to the primary transfer units.

At timing S12, the primary transfer is started with the first image formation station a. Toner images are transferred one by one from the photosensitive drums 1*a* to 1*d* to the intermediate transfer belt 10. At timing S13, toner images on the intermediate transfer belt 10 reach the secondary transfer unit. The transfer control unit 201 changes the secondary transfer voltage to the voltage V3 necessary for the secondary transfer, transferring the toner images on a recording material P. When the voltage V3 is applied from the secondary transfer power supply 21 to the secondary transfer roller 20, the secondary transfer current i2 flowing into the secondary transfer roller 20 is an optimal current I2 of, for example, 15 μA. Here, since a current of 15 μA is supplied from the secondary transfer roller 20, and a current of 7 μA is supplied from the brush member 19, a total current value of these currents is 22 μA, which is larger than an optimal primary transfer current. However, by the action of the current restriction circuit 17, the optimal primary transfer current, for example, 20 μA is supplied to the metal rollers 14.

Next, at timing S14, the primary transfer is terminated. The current supply from the brush member 19 is terminated. With this termination, the primary transfer current decreases at timing S14. At timing S15, the secondary transfer is terminated, and the current supply from the secondary transfer roller 20 is terminated. With this termination, the primary transfer current becomes zero at timing S15. At timing S15, the image forming operation is terminated.

In this manner, the transfer control unit 201 causes the voltage V2, which is a third voltage, to be applied from the secondary transfer power supply 21 to the secondary transfer roller 20 before toner images formed on the respective multiple photosensitive drums 1*a* to 1*d* are transferred to the intermediate transfer belt 10. The transfer control unit 201 causes a fourth voltage to be applied from the high-voltage power supply 60 to the brush member 19 before toner images formed on the respective multiple photosensitive drums 1*a* to 1*d* are transferred to the intermediate transfer belt 10. To transfer the toner images on the intermediate transfer belt 10 on the recording material P, the transfer control unit 201 causes the voltage V3 to be applied to the secondary transfer roller 20 while maintaining the application of the fourth voltage from the high-voltage power supply 60. The voltage V3 is a fifth voltage higher than the voltage V2, which is a third voltage.

As illustrated in FIG. 11B, even when the voltage output from the secondary transfer power supply is changed under the control of the transfer control unit 201 according to the image forming operation, the current flowing into the primary transfer units is supplemented with the current supply from the brush member 19. This configuration enables a predetermined current to flow into the primary transfer units. Embodiment 5 therefore can perform the primary transfer satisfactorily while improving the secondary transfer performance. In FIG. 11B, the current supply to the primary transfer units is started from the secondary transfer roller 20 and the brush member 19 at a timing of S11. However, if the amount of current supplied from the brush member 19 to the primary transfer units sufficiently supplies an amount of current necessary for the primary transfer, the voltage V2 from the secondary transfer power supply 21 to the secondary transfer roller 20 need not to be applied at a timing of S11, and such configurations will not be eliminated from the scope of the invention. The current restriction circuit 17 illustrated in FIG. 11A may be the current restriction circuit 17 of Embodiment 1 or Embodiment 2 or may be the current restriction circuit 27 of Embodiment 4. To the current path between the opposing roller 13 and the current restriction circuit 17 or 27, the Zener diode 15*z* of the Embodiment 3 may be connected. As seen from the above, according to Embodiment 5, the primary transfer potential can be generated in such a manner that deals with fluctuations in the impedance of the primary transfer units.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-249533, filed Dec. 22, 2016 which is hereby incorporated by reference herein in its entirety.

What is claimed is:

1. An image forming apparatus comprising:

an image bearing member configured to bear a toner image;

an intermediate transfer belt onto which a toner image is primarily transferred from the image bearing member, the intermediate transfer belt having a conductivity and being endless;

a secondary transfer member configured to secondarily transfer the toner image from the intermediate transfer belt to a transfer member, the secondary transfer member contacting an outer peripheral surface of the intermediate transfer belt;

a transfer power supply configured to apply a voltage to the secondary transfer member;

an opposing member supporting an inner peripheral surface of the intermediate transfer belt, the opposing member provided to oppose the secondary transfer member through the intermediate transfer belt;

a contact member corresponding to and opposed to the image bearing member through the intermediate transfer belt, the contact member contacting the inner peripheral surface of the intermediate transfer belt; and a current restriction circuit electrically connected to the contact member and the opposing member, the current restriction circuit restricting an amount of current flowing from the opposing member to the contact member, in a case where a voltage is applied from the transfer power supply to the secondary transfer member, to a predetermined amount of current, independently of variation of resistance value of the intermediate transfer belt.

2. An image forming apparatus according to claim 1, wherein the toner image formed on the image bearing member is transferred to the intermediate transfer belt by the predetermined amount of current flowing from the current restriction circuit to the contact member.

3. An image forming apparatus according to claim 1, wherein the current restriction circuit comprises:

a resistor element including one end connected to a tensioning member and another end connected to the contact member; and a PNP transistor including an emitter terminal connected to the tensioning member and the one end of the resistor element, a base terminal connected to the contact member and the other end of the resistor element, and a collector terminal grounded.

4. An image forming apparatus according to claim 1, further comprising:

a control unit configured to control a voltage applied by the transfer power supply, wherein the control unit controls the transfer power supply so that a first voltage is applied to the secondary transfer member before transferring the toner image formed on the image bearing member to the intermediate transfer belt, and a second voltage higher than the first voltage is applied to the secondary transfer member in a case where the toner image is transferred from the intermediate transfer belt to a recording material.

5. An image forming apparatus according to claim 4, wherein the control unit controls a voltage applied to the secondary transfer member by the transfer power supply so that an amount of current flowing into the secondary transfer member is equal to or larger than a predetermined amount of current required for transferring the toner image formed on the image bearing member to the intermediate transfer belt.

6. An image forming apparatus according to claim 1, wherein the current restriction circuit comprises:

a resistor element including one end connected to a tensioning member and another end connected to the contact member;

a thermistor including one end connected to the tensioning member and the one end of the resistor element, and another end connected to the contact member and the other end of the resistor element; and a PNP transistor including an emitter terminal connected to the tensioning member, the one end of the resistor element, and the one end of the thermistor, a base terminal connected to the contact member, the other end of the resistor element, and the other end of the thermistor, and a collector terminal grounded.

7. An image forming apparatus according to claim 6, wherein the thermistor is a thermistor whose resistance value decreases according to an increase of temperature.

8. An image forming apparatus according to claim 1, wherein the transfer power supply is capable of applying voltages of a positive polarity and a negative polarity to the secondary transfer member, and the image forming apparatus comprises a first smoothing element including a cathode terminal connected to a tensioning member and an anode terminal connected to the contact member, the first smoothing element being connected to the current restriction circuit in parallel.

9. An image forming apparatus according to claim 8, wherein the current restriction circuit comprises:

a first resistor element including one end connected to the tensioning member and another end connected to the contact member;

a PNP transistor including an emitter terminal connected to the tensioning member and the one end of the first resistor element, a base terminal connected to the contact member and the other end of the first resistor element, and a collector terminal;

a second resistor element connected between the emitter terminal and the collector terminal of the PNP transistor; and a second smoothing element including an anode terminal connected to the collector terminal of the PNP transistor and a cathode terminal grounded, wherein the collector terminal of the PNP transistor is grounded through the cathode terminal of the second smoothing element.

10. An image forming apparatus according to claim 1, further comprising:

a charge member configured to charge toner residing on the intermediate transfer belt so as to remove the toner residing on the intermediate transfer belt after the toner image on the intermediate transfer belt is transferred to a recording material; and a charge power supply configured to apply a voltage to the charge member, wherein a current flows from the charge member to the current restriction circuit through the intermediate transfer belt and the opposing member in a case where the charge power supply applies a voltage to the charge member.

11. An image forming apparatus according to claim 10, further comprising:

a control unit configured to control a voltage applied by the transfer power supply and a voltage applied by the charge power supply, wherein the control unit causes a third voltage to be applied from the transfer power supply to the secondary transfer member and causes a fourth voltage to be applied from the charge power supply to the charge member before the toner image formed on the image bearing member is transferred to the intermediate transfer belt, and controls the transfer power supply and the charge power supply so that a fifth voltage higher than the third voltage is applied from the transfer power supply to the secondary transfer member while maintaining application of the fourth voltage from the charge power supply in a case where the toner image transferred on the intermediate transfer belt is transferred to the recording material.

12. An image forming apparatus according to claim 11, wherein the control unit controls a voltage applied to the secondary transfer member by the transfer power supply and a voltage applied to the charge member by the charge power supply so that a total of an amount of current flowing into the secondary transfer member and an amount of current flowing into the charge member is equal to or greater than a predetermined amount of current required for transferring the toner image formed on the image bearing member to the intermediate transfer belt.

13. An image forming apparatus according to claim 1, further comprising a voltage maintaining element connected to a path of current between the opposing member and the current restriction circuit, and configured to maintain a voltage at a predetermined voltage.

14. An image forming apparatus according to claim 13, wherein the voltage maintaining element is a Zener diode.

15. An image forming apparatus according to claim 1, wherein the opposing member is an opposing roller forming a nipping unit with the secondary transfer member.

16. An image forming apparatus according to claim 1, wherein the contact member is a metal roller.

17. An image forming apparatus according to claim 1, further comprising:

a control unit configured to control a voltage applied by the transfer power supply; and a detection unit configured to detect a current flowing into the secondary transfer member when a voltage is applied to the secondary transfer member by the transfer power supply, wherein the control unit controls the voltage applied to the secondary transfer member based on a detection result from the detection unit.

18. An image forming apparatus according to claim 1, further comprising:

one or more image bearing members; and one or more contact members, each of which corresponding to and opposed to one of the one or more image bearing members through the intermediate transfer belt, the one or more contact members contacting the inner peripheral surface of the intermediate transfer belt, wherein toner images formed on the image bearing members are transferred to the intermediate transfer belt by the predetermined current flowing from the current restriction circuit to the contact members.

19. An image forming apparatus according to claim 18, further comprising:

a control unit configured to control a voltage applied by the transfer power supply, wherein the control unit controls the transfer power supply so that a first voltage is applied to the secondary transfer member before transferring each of the toner images formed on the image bearing members to the intermediate transfer belt, and a second voltage higher than the first voltage is applied to the secondary transfer member in a case where the toner images are transferred from the intermediate transfer belt to a recording material.

20. An image forming apparatus according to claim 18, further comprising:

a control unit configured to control a voltage applied by the transfer power supply and a voltage applied by a charge power supply, wherein the control unit causes a third voltage to be applied from the transfer power supply to the secondary transfer member and causes a fourth voltage to be applied from the charge power supply to a charge member before the each of toner images formed on the image bearing members is transferred to the intermediate transfer belt, and controls the transfer power supply and the charge power supply so that a fifth voltage higher than the third voltage is applied from the transfer power supply to the secondary transfer member while maintaining application of the fourth voltage from the charge power supply in a case where each of the toner images transferred on the intermediate transfer belt is transferred to a recording material.

* * * * *